US007963209B2

(12) United States Patent
Olsen et al.

(10) Patent No.: US 7,963,209 B2
(45) Date of Patent: Jun. 21, 2011

(54) WATER HYDRAULIC MACHINE

(75) Inventors: Palle Olsen, Nordborg (DK); Ove Thorboel Hansen, Nordborg (DK); Lars Martensen, Soenderborg (DK)

(73) Assignee: Danfoss A/S, Nordborg (DK)

( * ) Notice: Subject to any disclaimer, the term of this patent is extended or adjusted under 35 U.S.C. 154(b) by 690 days.

(21) Appl. No.: 11/949,149

(22) Filed: Dec. 3, 2007

(65) Prior Publication Data

US 2008/0223207 A1 Sep. 18, 2008

(30) Foreign Application Priority Data

Dec. 4, 2006 (DE) ..... 10 2006 057 364

(51) Int. Cl.
*F01B 13/04* (2006.01)

(52) U.S. Cl. ..... 92/12.2; 92/57; 92/71

(58) Field of Classification Search ..... 92/12.2, 92/57, 71; 417/269; 74/60; 91/499
See application file for complete search history.

(56) References Cited

U.S. PATENT DOCUMENTS 3,866,518 A * 2/1975 Miyao et al. ..... 91/488
4,644,850 A * 2/1987 Kanamaru et al. ..... 91/507
5,601,009 A 2/1997 Jepsen et al.
5,762,477 A * 6/1998 Jepsen et al. ..... 417/269
5,813,315 A * 9/1998 Kristensen et al. ..... 92/71

FOREIGN PATENT DOCUMENTS

| | | |
|---|---|---|
| DE | 102 23 844 A1 | 12/2003 |
| EP | 98/39568 | 9/1998 |
| JP | 2004-84660 | 3/2004 |

* cited by examiner

*Primary Examiner* — Hoang M Nguyen
(74) *Attorney, Agent, or Firm* — McCormick, Paulding & Huber LLP

(57) ABSTRACT

Motor start circuit for an induction motor, particularly a single-phase AC induction motor, with a main winding (4) and an auxiliary winding (5), which are supplied with current, particularly alternating current, via current supply connections (24, 25), and with a start switching device (15) serving the purpose of interrupting the current flow through the auxiliary winding (5) after the start of the motor, the start switching device (15) being connected to a control device (20) via a connector (18), the control device (20) being connected between the current supply connections (24, 25), and with a winding protection switch (28), which is normally closed and which opens on the occurrence of a fault. The invention is characterized in that the control device (20) is connected to the winding protection switch (28) via at least one further connector (22, 17), preferably via at least one further connector (22, 17) and the auxiliary winding (5).

15 Claims, 2 Drawing Sheets

Fig.1
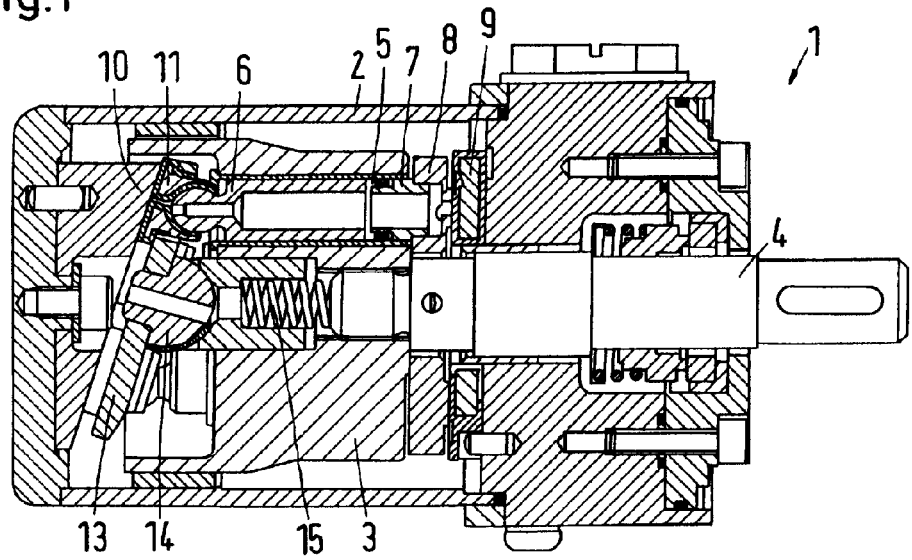
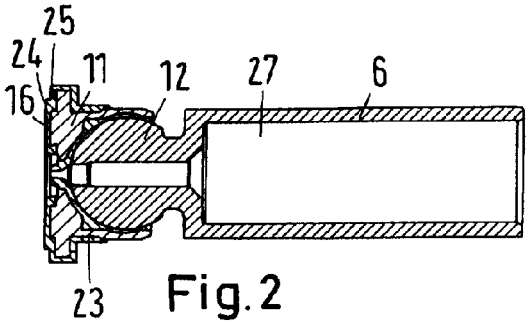
Fig.2
Fig.3
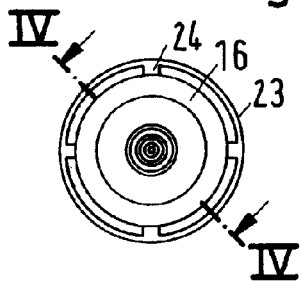
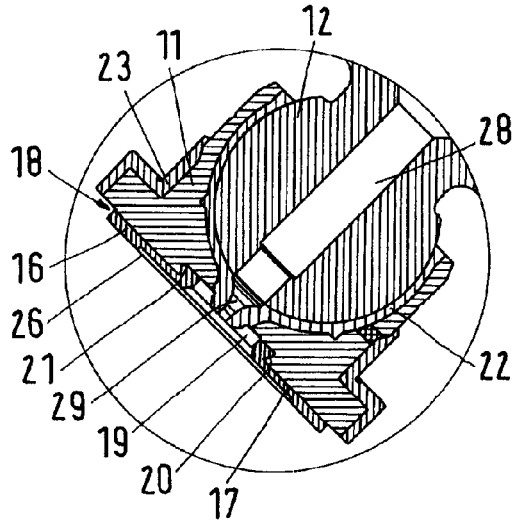
Fig.4

WATER HYDRAULIC MACHINE

CROSS REFERENCE TO RELATED APPLICATION

Applicant hereby claims foreign priority benefits under U.S.C. §119 from German Patent Application No. 10 2006 057 364.1 filed on Dec. 4, 2006, the contents of which are incorporated by reference herein.

FIELD OF THE INVENTION

The invention concerns a water hydraulic machine with at least one piston arranged to be movable in a cylinder, the piston being connected to a slide shoe that has a sliding surface, with which it is supported on a swashplate, a friction reducing plastic material being arranged between the sliding surface and the swashplate.

BACKGROUND OF THE INVENTION

Such a water hydraulic machine is, for example, known from DE 102 23 844 A1. Such a machine works with water as hydraulic medium. As water has no lubricating properties, a friction reducing plastic material is used to ensure that parts moving in relation to each other can slide on each other in the most low-wear manner possible.

For the purposes of the following description, the term "friction reducing" must always be understood so that the plastic material interacts with the material, on which it bears, in a friction reducing manner. If, for example, the swashplate is made of steel, the plastic material interacts with the steel in a low-friction manner.

Water hydraulic machines as offered by Danfoss A/S, Nordborg, Denmark under the name "Nessie" have proved their value in many applications. For example, such a water hydraulic machine can be used as pump in a reverse osmosis system.

If the water hydraulic machine has to be dimensioned for a high performance, it may turn out that damages occur on the friction reducing plastic material after a certain operation time.

SUMMARY OF THE INVENTION

The invention is based on the task of securing a sufficient lifetime also of high-performance water hydraulic machines.

With a water hydraulic machine as mentioned in the introduction, this task is solved in that a contact zone between the sliding surface and the plastic material is made to be radially exposed in at least one position in the circumferential direction.

With this solution it is assumed that particularly with large pumps with a delivery rate in the range of several 100 l/min and a delivery pressure of 50 bar or more damages to the plastic material on the sliding surface sometimes appear, which cause that water can penetrate to the area between the plastic material and the sliding surface, that is, into the contact zone. Now, this water can escape from the contact zone without problems, as in the radial direction the contact zone has an exposed area, which is not, as it has been the case until now, covered or closed by a further area of the plastic material. Accordingly, an excessively high pressure cannot build up between the plastic material and the sliding surface, which would eventually cause the plastic material to get detached from the sliding surface. Thus, also when the plastic material has no damages, like cracks or the like, it otherwise remains stable on the sliding surface.

Preferably, the contact zone is made to be exposed radially outwards. Here, the term "radially outwards" relates to the slide shoe, which usually has a circular sliding surface. Also when the shape of the sliding surface deviates from the circular shape, "radial" means a direction which extends from the centre of the slide shoe and outwards. At the radial outside of the slide shoe the smallest water pressure rules, so that water, which has entered between the plastic material and the sliding surface, can escape here.

Preferably, the plastic material has a circumferential projection extending in the direction of the swashplate, the projection surrounding an area, whose surface is as large as a pressure application surface of the piston in the cylinder. Thus a pressure relief can be achieved, when water gathers in the area, which is, in a manner of speaking, supporting the slide on the swashplate.

This is particularly the case, if the area is connected to a pressure chamber located in the cylinder. Then, it is easy to make sure that the same pressure as in the cylinder always rules in this area. However, this is exactly the pressure that acts upon the piston and presses the slide shoe against the swashplate via the piston. As the surfaces are equally large, a power balance occurs. In this way, the mechanical stress on the plastic material is small.

Preferably, the plastic material is connected to the slide shoe in a form-fitting manner. Firstly, this form-fitting connection must ensure that no displacements can take place between the plastic material and the sliding surface parallel to the sliding surface. A form-fitting connection can also be realised, when the contact zone between the slide shoe and the plastic material is open in the circumferential direction in one position or in some positions, so that water, which has penetrated between the sliding surface and the plastic material, can escape here.

Preferably, the sliding surface of the slide shoe has an undercut recess in the radial direction, said recess being engaged by the plastic material. This gives two effects. Firstly, the plastic material is not only fixed in a direction, which is parallel to the sliding surface of the slide shoe, but also in a direction, which is perpendicular to said surface. The plastic material engages the undercut of the recess and is thus particularly well fixed. Secondly, such an undercut causes an increased sealing length, so that the risk that water penetrates into the area of the recess between the slide shoe and the plastic material can be kept small.

Preferably, in the recess the plastic material surrounds a bore in the sliding surface, in which a working pressure in the cylinder rules. The working pressure then pushes the plastic material radially outwards and provides an improved sealing between the plastic material and the slide shoe. The working pressure can, for example, be provided in that the piston has a channel that ends in the recess.

Preferably, the circumference of the slide shoe is covered by a layer of a friction reducing synthetic material, having at several positions in the circumferential direction a connection to the plastic material. The plastic material and the synthetic material can be made in the same manner. The synthetic material ensures that the slide shoe is movable in relation to a pressure plate without causing considerable wear. This synthetic material can then at the same time be used to fix the plastic material to the sliding surface. Still, interruptions remain, in which the contact zone between the plastic material and the sliding surface is not covered, so that here entered water can escape from the contact zone.

Preferably, at least one of the connections is form-fitting with the sliding surface in the circumferential direction. This can, for example, be realised in that the connection between the synthetic material and the plastic material is located in a groove in the sliding surface, the groove extending substantially in the radial direction. This gives an even better fixing of the plastic material on the slide shoe.

An alternative embodiment may foresee that the plastic material is made as a disc, which is connected to the slide shoe by means of plug connection extending in a direction that is perpendicular to the sliding surface. With this embodiment it is considered that during operation basically only shear forces act in parallel to the sliding surface upon the connection between the slide shoe and the plastic material. Axial forces, that is, forces perpendicular to the sliding surface, have practically no damaging effect, as the piston always presses the slide shoe against the swashplate with sufficient force. When the plastic material is made as a disc, which is merely attached or pushed in, this disc can easily be replaced if required, without requiring the replacement of further elements of the machine. This simplifies the maintenance and reduces the cost of the maintenance. The lifetime of the machine can be substantially extended by replacing such a disc.

It is preferred that the side of the disc facing the sliding surface has a recess. Thus, water is permitted to penetrate into the area between the disc and the sliding surface. This water has no problems to escape at another position, so that the cohesion between the disc and the slide shoe in a direction parallel to the sliding surface is practically not impaired.

Preferably, the recess has a surface, which is smaller than the surface of the area. The pressure ruling in the area then presses the disc with a sufficient force against the sliding surface and at the same time supports the slide shoe in a hydraulic balance in relation to the swashplate.

Preferably, the slide shoe has a projection projecting from the sliding surface, the disc being attached to said projection. This is a particularly simple embodiment. The whole circumference of the disc can then be exposed, so that also the contact zone between the disc and the slide shoe is made to be exposed on the whole circumference. Water penetrating between the slide disc and the plastic material can then escape radially outwards in any position.

It is preferred that the projection is made as an extension of a plastic material element, which is located between the slide shoe and a ball fixed on the piston. The plastic material element is also made from a friction reducing plastic material and ensures that the slide shoe can swing randomly in relation to the piston in such a manner that the sliding surface always remains aligned in parallel with the swashplate. In many cases, the plastic material element will be injected into or sprayed onto the ball. When, now, this plastic material element is left to project somewhat from the sliding surface, a simply designed "spike" appears, on which the disc forming the plastic material can be attached.

An alternative embodiment may provide that the slide shoe has a locking ring, into which the disc is inserted. The disc is then not fixed radially inside, but radially outside. Also this is a simple way of securing the disc against a displacement in parallel with the sliding surface.

It is advantageous, if the locking ring is formed as an extension of the plastic material. In this case, no additional element is required to form the locking ring. The plastic material merely has to be somewhat extended. As the plastic material is fixed on the slide shoe anyway, this provides a sufficient fixing of the disc.

Preferably, the locking ring has at least one opening in the circumferential direction, said opening being connected to an annular groove, which is formed between the plastic material and the slide shoe. Water that has penetrated between the sliding surface and the plastic material can enter into the annular groove. As the annular groove is connected to the opening, the water can then escape from the contact zone between the plastic material and the sliding surface without building up excessive pressures.

BRIEF DESCRIPTION OF THE DRAWINGS

In the following, the invention is described on the basis of preferred embodiments in connection with the drawings, showing:

FIG. 1 is a schematic section through a water hydraulic machine;

FIG. 2 shows a section through a piston of the water hydraulic machine with slide shoe;

FIG. 3 is a front view of the slide shoe;

FIG. 4 is an enlarged view of a section IV-IV according to FIG. 3;

DETAILED DESCRIPTION OF THE PREFERRED EMBODIMENTS

Figure 5:
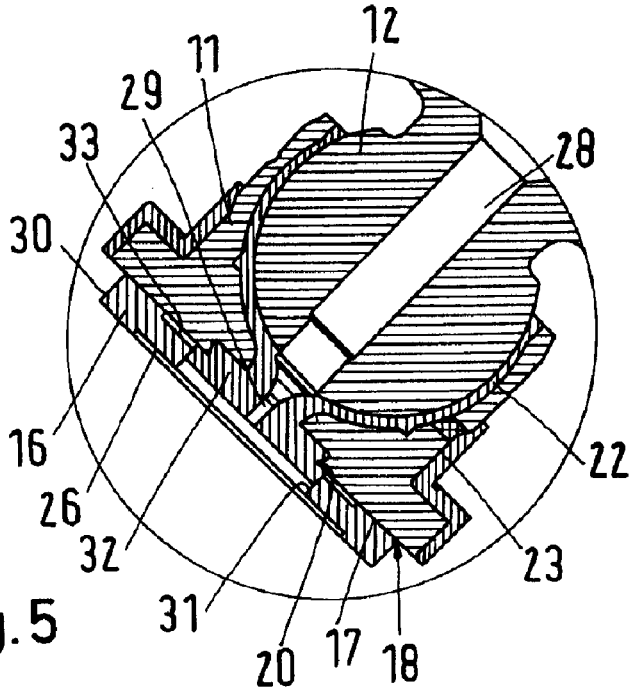
FIG. 5 is an embodiment modified in relation to FIG. 4.

A water hydraulic machine 1 has a housing 2, in which a cylinder drum 3 is rotatably supported. The cylinder drum 3 is unrotatably connected to a drive shaft 4.

Several cylinders 5 are located and uniformly distributed in the circumferential direction in the cylinder drum 3. A piston 6 is movably guided in each cylinder. The cylinder 5 is connected to a valve plate 8 via a connecting socket 7, the valve plate 8 interacting with a control plate 9. During operation, the valve plate 8 rotates in relation to the control plate 9.

The machine 1 is made as a pump having a delivery performance of 500 l/min and a delivery pressure of 60 bar.

The drive of the piston 6 occurs via a swashplate 10. Each piston 6 is connected to a slide shoe 11, the connection being made by means of a ball 12, so that the slide shoe 11 can be tilted in relation to the piston 6. By means of a pressure plate 13 the slide shoes 11 are kept to bear on the swashplate 10. The pressure plate 13 again is supported on the cylinder drum 3 via a ball joint 14 and a spring 15.

When the cylinder drum 3 rotates under the effect of a torque acting upon the drive shaft 4, the pistons 6 are reciprocated, in a manner known per se, in the axial direction of the cylinder drum 3 by the slide shoes 11 bearing on the swashplate 10. The machine then works as a pump. If the cylinders 5 are supplied with hydraulic fluid in the right position, the shaft 4 is rotated, and the machine works as a motor.

The machine 1 works with water as hydraulic medium. The inside of the housing 2 is usually also filled with water, even though this is not absolutely necessary. As known, water has no lubricating properties. In order to keep the friction between the swashplate 10 and the slide shoe 11 low, a friction reducing plastic material 16 is located between a sliding surface 17 of the slide shoe and the swashplate 10. The friction reducing plastic material is especially a high-resistant thermoplastic plastic material on the basis of polyaryl etherketones, particularly polyetheretherketones (PEEK), polyamides, polyacetals, polyarylethers, polyethylene terephthalates, polyphenylene sulfides, polysulphones, polyether sulphones, polyether imides, polyamide imides, polyacrylates, phenol resins, like novolacquer resins or the like. The plastic material can be provided with a filling of glass, graphite, polytetra flourethylene or carbon, the fillings being particularly useful as fibres. Selecting one of these materials will provide excellent operation behaviour, when water is used as hydraulic fluid. Also the use of a DLC layer (DLC=diamond-like carbon) is possible, as described in DE 102 23 844 A1.

When larger pumps are concerned, as in the present case, there will be a risk, under unfavourable conditions, that the plastic material 16 is damaged, for example, small cracks may occur. In this case, water can penetrate in a contact zone 18 between the plastic material 16 and the sliding surface 17. To prevent this penetrating water from building up an impermissibly high pressure between the plastic material 16 and the sliding surface 17, it is provided, as appears from FIG. 4, that the contact zone 18 is radially exposed on the circumference, that is, it is not covered or closed by any other elements. Water that has penetrated into the contact zone 18 can thus escape radially outwards. In particular, this is possible because practically no higher pressure prevails at the radial outside of the slide shoe 11 (in relation to the slide shoe 11). The sliding surface 17 has a recess 19, which is provided with a radial undercut 20. A projection 21 extending radially outwards from the plastic material 16 engages in this undercut 20. Thus, the plastic material 16 on the sliding surface is not only secured against shear forces acting in parallel to the sliding surface 17. It is also secured against axial forces, that is, forces acting in the movement direction of the piston 6. Further, the projection has the advantage that also here a sealing is realised by the pressure acting upon the plastic material.

Between the ball 12 and the slide shoe 11 is located a plastic material element 22, which is also made of a friction reducing plastic material. Also here, it is possible for water to penetrate between the ball 12 and the plastic material element. Preferably, the plastic material element 22 is made of the same material as the plastic material 16. The plastic material element 22 is preferably made so that it is sprayed onto the slide shoe 11.

At least in an area, in which it interacts with the pressure plate 13, the slide shoe 11 is surrounded by a plastic material 23. The plastic material 23 is also a friction reducing plastic material, preferably the same material as the plastic material 16.

As appears from the FIGS. 2 and 3, the plastic material 16 and the plastic material 23 are connected to each other via a total of four connections 24 distributed evenly in the circumferential direction. The connections 24 are located in radially extending grooves 25, which are formed in the slide shoe 11. The plastic material 23 and thus also the plastic material 16 are thus also secured against rotation in relation to the slide shoe 11. In the positions, in which the connections 24 are located, the contact zone 18 is covered on the radial outside. This is, however, uncritical, as penetrated water has sufficient free space to escape from the contact zone 18.

On the side adjacent to swashplate 10, the plastic material 16 has a recessed area 26. This area 26 has a surface corresponding to the pressure surface in the cylinder 5. Via a channel 27 formed in the piston 6, a section 28 of the channel also passing through the ball 12 and extending with a channel 29 through the plastic material element 22 into the recess 19, the inside of the cylinder 5 is connected to the inner chamber of the cylinder 5. Thus, the pressure acting upon the piston 6 also acts in the area 26. As the surfaces, upon which the same pressure acts, are also equal, a hydraulic balance rules at the piston 6. The force, with which the plastic material bears on the swashplate 10, is therefore mainly determined by the force of the spring 15.

FIG. 5 shows a modified embodiment of the slide shoe 11, in which the same elements are provided with the same reference numbers as in FIG. 4.

The plastic material 16 is now made as a disc 30, which is merely attached to the slide shoe.

For this purpose the disc 30 has a central opening 31. The plastic material element 22 is extended so that it projects with an extension 32 over the sliding surface 17. The extension 32 engages in the undercut 20, which gives an additionally improved stability. The extension 32 is penetrated by the section 29 of the channel 27, so that the extension 32 is pressed against the slide shoe 11 in the axial direction by the pressure ruling in the cylinder 5.

On the side facing the sliding surface 17, the disc 30 has a further recess 33, whose surface, however, is smaller than the surface of the area 26. Even if water should penetrate between the disc 30 and the sliding surface 17, the jacking force ruling in the area 26 via the pressure will be sufficient to hold the bearing of the disc 30 on the slide shoe 11 with sufficient force.

During operation, the forces acting upon the disc 30 will mainly be directed in parallel to the sliding surface 17. These forces are then adopted by the extension 32. Otherwise, the pressure plate 13 ensures that the disc 30 is retained between the slide shoe 11 and the swashplate 10.

Also here the contact zone 18 is open towards the outside. In the embodiment according to FIG. 5 the contact zone 18 can even be open on its whole circumference.

Figure 6:
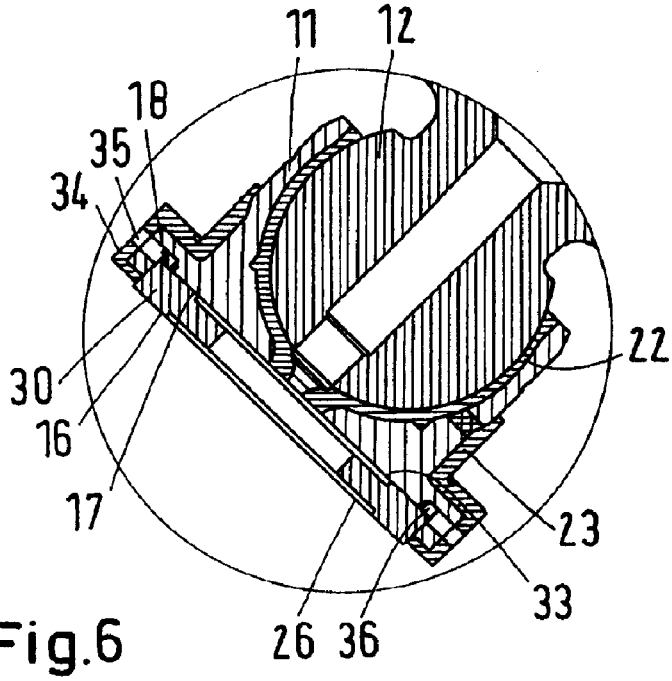
FIG. 6 is a further embodiment modified in relation to FIG. 4.

FIG. 6 shows a further modification according to FIG. 4, in which the same elements are provided with the same reference numbers.

In this case, the plastic material 16 is again made as a disc 30, which can have the same dimensions and properties as in the embodiment according to FIG. 5. The disc 30 is held in that the plastic material 23 has been extended from the circumference of the slide shoe 11 in the direction of the swashplate 10 and forms a locking ring 34. Distributed on its circumference, the locking ring 34 has several openings 35, which are connected to an annular groove 36, which again surrounds the contact zone 18.

Water that penetrates into the area between plastic material 16 and the sliding surface 17 can thus escape or be pressed radially outwards into the annular groove 36. From here the water can flow outwards via the openings 35 into the inside of the housing 2.

When maintaining a machine 1 having the embodiment according to FIGS. 5 and 6, the disc 30 can merely be replaced without requiring replacement of other elements. This keeps the maintenance costs small and provides a simple way of extending the lifetime of the machine 1.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A water hydraulic machine with at least one piston arranged to be movable in a cylinder, the piston being connected to a slide shoe that has a sliding surface, with which it is supported on a swashplate, a friction reducing plastic material being arranged between the sliding surface and the swashplate, wherein a contact zone between the sliding surface and the plastic material is made to be radially exposed in at least one position in the circumferential direction, the plastic material having a circumferential projection extending in the direction of the swashplate, the projection surrounding an area that is connected to a pressure chamber located in the cylinder, wherein the area has a surface being as large as a pressure application surface of the piston in the cylinder.

2. The machine according to claim 1, wherein the contact zone is made to be exposed radially outwards.

3. The machine according to claim 1, wherein the plastic material is connected to the slide shoe in a form-fitting manner.

4. The machine according to claim 3, wherein the sliding surface of the slide shoe has an undercut recess in the radial direction, said recess being engaged by the plastic material.

5. The machine according to claim 4, wherein in the recess the plastic material surrounds a bore in the sliding surface, in which a working pressure in the cylinder rules.

6. The machine according to claim 1, wherein the circumference of the slide shoe is covered by a layer of a friction reducing synthetic material, having at several positions in the circumferential direction a connection to the plastic material.

7. The machine according to claim 6, wherein at least one of the connections is form-fitting with the sliding surface in the circumferential direction.

8. The machine according to claim 1, wherein the plastic material is made as a disc, which is connected to the slide shoe by means of plug connection extending in a direction that is perpendicular to the sliding surface.

9. The machine according to claim 8, wherein the side of the disc facing the sliding surface has a recess.

10. The machine according to claim 9, the recess has a surface, which is smaller than the surface of the area.

11. The machine according to claim 8, wherein the slide shoe has a projection projecting from the sliding surface, the disc being attached to said projection.

12. The machine according to claim 11, wherein the projection is made as an extension of a plastic material element, which is located between the slide shoe and a ball fixed on the piston.

13. The machine according to claim 8, wherein the slide shoe has a locking ring, into which the disc is inserted.

14. The machine according to claim 13, wherein the locking ring is formed as an extension of the plastic material.

15. The machine according to claim 13 wherein the locking ring has at least one opening in the circumferential direction, said opening being connected to an annular groove, which is formed between the plastic material and the slide shoe.

* * * * *